US005593524A

United States Patent [19]

Philips

[11] Patent Number: 5,593,524

[45] Date of Patent: Jan. 14, 1997

[54] ELECTRICAL CABLE REINFORCED WITH A LONGITUDINALLY APPLIED TAPE

[76] Inventor: Peter A. Philips, 63 Mountain View Ter., Hillsdale, N.J. 07642

[21] Appl. No.: 339,493

[22] Filed: Nov. 14, 1994

[51] Int. Cl.[6] ..... H01B 7/02; H01B 13/22

[52] U.S. Cl. ..... 156/51; 156/244.12; 156/307.7; 174/120 R

[58] Field of Search ..... 174/121 R, 120 R, 174/121 AR, 120 SR; 156/51, 53, 54, 307.7, 244.12

[56] References Cited

U.S. PATENT DOCUMENTS

| | | | |
|---|---|---|---|
| 3,576,940 | 5/1971 | Stone | 174/113 |
| 3,668,302 | 6/1972 | Boland et al. | 174/121 A |
| 3,701,840 | 10/1972 | Willmore | 174/107 |
| 3,745,233 | 7/1973 | Lania et al. | 174/113 R |
| 4,358,636 | 11/1982 | Iiff et al. | 174/103 X |
| 4,600,461 | 7/1986 | Guy | 156/244.12 |
| 4,810,834 | 3/1989 | Grogl et al. | 174/121 R |
| 4,818,438 | 4/1989 | Wiley | 252/511 X |
| 5,043,530 | 8/1991 | Davies | 174/36 X |
| 5,105,057 | 4/1992 | Weinberg | 174/121 R |
| 5,395,665 | 3/1995 | Planeta | 428/36.1 X |
| 5,397,860 | 3/1995 | Yochum et al. | 174/113 C X |

*Primary Examiner*—Kristine L. Kincaid
*Assistant Examiner*—Chau N. Nguyen
*Attorney, Agent, or Firm*—Plevy & Associates

[57] ABSTRACT

A cable having a conductor for conducting electrical current, a first layer of insulation encircling the conductor for insulating the conductor, a mesh tape applied over the first layer of insulation for reinforcing the cable and substantially limiting the cable from stretching when the cable is placed in tension, and a second layer of insulation encircling and interwoven with the mesh tape. Also provided is a method for manufacturing the cable described above.

8 Claims, 3 Drawing Sheets

ELECTRICAL CABLE REINFORCED WITH A LONGITUDINALLY APPLIED TAPE

FIELD OF INVENTION

This invention relates to an improved electrical cable and method of making the same. More particularly, this invention relates to an electrical cable employing a reinforcing layer of longitudinally applied tape.

BACKGROUND OF THE INVENTION

Automotive ignition systems typically produce 20,000 to 40,000 volts at the ignition coil. The electrical current produced by this voltage is transferred from the distributor to the spark plugs of each cylinder via spark plug ignition cables.

A typical prior art spark plug ignition cable is shown in FIG. 1 and is denoted by the numeral 10. Prior art cable 10 comprises a conductor 12 surrounded by a primary insulation layer 14 made from silicone rubber or like material. The primary insulation layer 14 is surrounded by a braided cable reinforcing layer 16 made from stranded fiberglass. The braided reinforcing layer 16 is surrounded by a secondary insulating layer 18 of silicone rubber or like material which forms the outer jacket of the cable.

The braided reinforcing layer substantially prevents the cable from stretching when a tension force is applied to the cable. This prevents "thinning" of the cable, i.e., cable diameter reduction, and assures that metal terminals applied by crimping to each end of a completed spark plug cable assembly, do not slip off the cable when the cable is under tension.

The prior art cable 10 shown in FIG. 1 is manufactured according to the following prior art method which is described in conjunction with FIG. 3. In the first step of the method, the conductor 12 of cable 10 is fed into a first extruding machine 30 which extrudes the primary insulation layer 14 over the conductor 12. The cable 12 then passes through a first vulcanizing chamber 31 to vulcanize the primary insulation layer 14. As the cable emerges from the vulcanizing chamber 31, it is wrapped onto one of many spools 32 used for collecting the cable 10 at this stage of manufacture.

In the second step of manufacture, the primary insulation layer 14 is overbraided with the reinforcing layer 16 of stranded fiberglass. This is accomplished by a process which employs a multiplicity of braiding machines 34. Since, these braiding machines 34 operate at a much slower rate of speed as compared with the extrusion machines, many braiding machines are required to keep up with the production output of each extrusion machine.

In any event, the cable 10 collected on each spool 32 is fed into an associated braiding machine 34. Each braiding machine 34 overbraids the primary insulation layer 14 with the reinforcing layer 16 of stranded fiberglass. The cables 10 emerging from each of the braiding machines 34 are collected on another set of spools 36.

In the third step of manufacture, the cable 10 collected on each of the spools 36 is fed into a second extruding machine 38 which extrudes the secondary insulation layer 18 over the braided layer 16. The cable 10 then passes through a second vulcanizing chamber 39 to vulcanize the secondary insulation layer 18. After vulcanizing the secondary insulation layer 18, the cable 10 emerging from the vulcanizing chamber 39 is collected onto a third set of spools 40.

The overbraiding process describe above is very slow and costly. This is because each braiding machine 34 can only produce approximately ten feet of braided wire per minute. Thus, approximately thirty braiding machines are required to keep up with each extrusion machine which operates at approximately 300 feet per minute. Accordingly, substantial capital expenditures must be made to procure the required number of braiding machines. Each braiding machine requires routine maintenance, set-up time, and floor space which further increases the cost of manufacturing. Further, because multiple braiding machines are required per extruding machine, in-line processing is not possible. In particular, the cable coming out of the first vulcanizing chamber must be collected on multiple spools for processing on the braiding machines, instead of being fed directly into the next processing area.

It is, therefore, a primary object of the present invention to provide an improved spark plug ignition cable that can be manufactured more efficiently and at a lower cost than prior art spark plug ignition cables.

SUMMARY OF THE INVENTION

A cable according to the present invention comprises conductive means for conducting electrical current and a first layer of insulation encircling the conductive means. The cable further comprises a second layer of insulation including a mesh tape interwoven therewith for substantially limiting the stretching of the cable when the cable is placed in tension.

Also according to the present invention is a method of manufacturing the cable described above, comprising the steps of providing conductive means for conducting electrical current and applying a first layer of insulation over the conductive means. A mesh tape is longitudinally applied around the first layer of insulation at substantially same time as a second layer of insulation is applied over the mesh tape.

BRIEF DESCRIPTION OF THE DRAWINGS

For a more complete understanding of the nature and objects of the invention, reference should be had to the following detailed description taken in connection with the accompanying drawings, in which.

DETAILED DESCRIPTION OF THE INVENTION

Although the present invention is intended for use as a spark plug ignition cable it should be understood that the present invention can also be used in other electrical cables.

Figure 2:
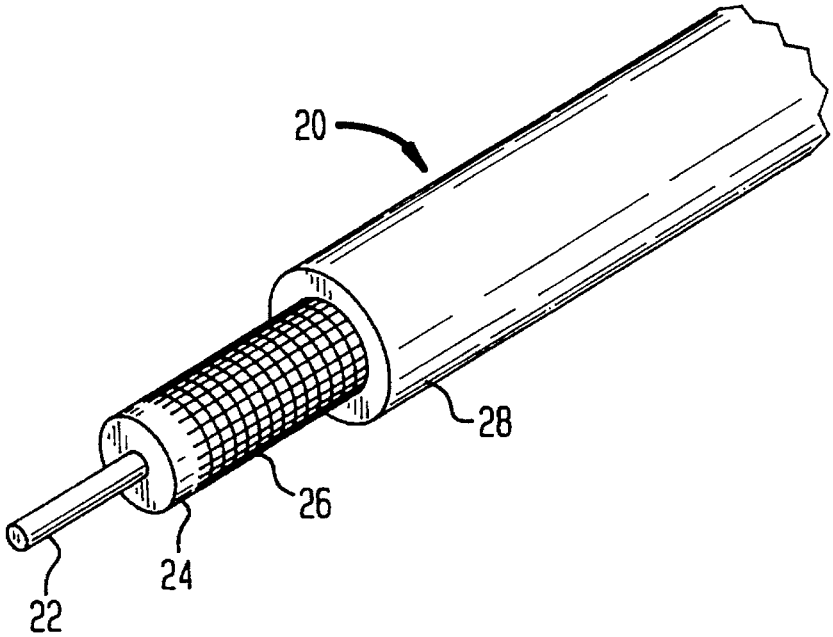
FIG. 2 is an isometric exploded view of a cable according to a preferred embodiment of the present invention.
Figure 3:
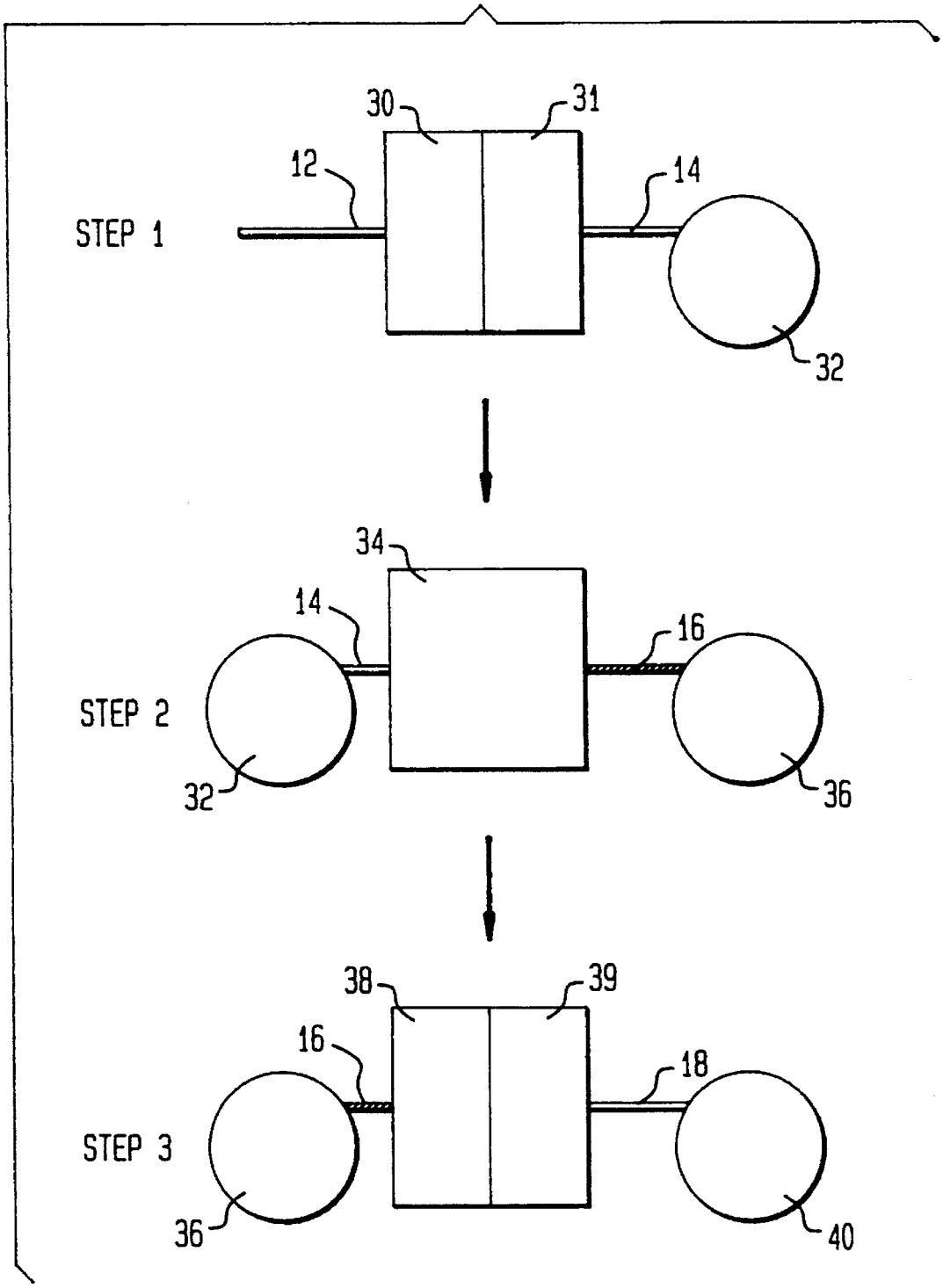
FIG. 3 (PRIOR ART)
FIG. 3 is a schematic representation of the steps employed in making the prior art cable shown in FIG. 1 as described in the background of the invention.

In FIG. 2, there is shown a preferred exemplary embodiment of a spark plug ignition cable of the present invention designated by the numeral 20. The center of the cable 20 generally comprises a conductor 22 having a diameter of approximately 0.050 inches. The conductor can be manufactured from a metal such as aluminum, inconel or other conductive alloys such as stainless steel. Alternatively, the conductor 22 can be manufactured from stranded fiberglass impregnated with granular or liquid graphite. The above-described conductors are all well known in the cabling art.

A layer of primary insulation 24 is applied over the conductor 22, such that the diameter of the primary insulation 24 is approximately 0.150 to 0.225 inches. In the preferred embodiment of the invention, the primary (commonly known as EPDM) insulation 24 comprises either ethylene propylene diene monomer or silicone rubber. It is understood, however, that any other well known material having suitable dielectric and high temperature properties can be used.

Figure 1:
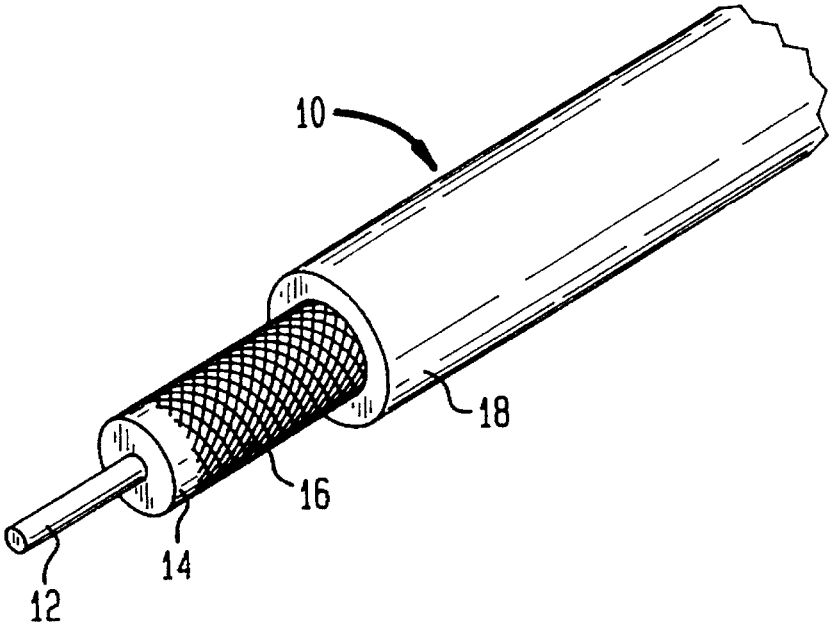
FIG. 1 (PRIOR ART)
FIG. 1 is an isometric exploded view of a prior art cable as described in the background of the invention.
Figure 5:
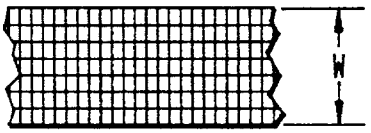
FIG. 5 is a plan view of the tape used in the preferred embodiment of the invention.

Immediately adjacent to the primary insulation layer 24, a layer of reinforcing mesh tape 26 is applied over the primary insulation layer 24 for reinforcing the cable. In the present invention, the reinforcing mesh tape 26 replaces the braided fiberglass yarn reinforcing layer in prior art spark ignition cable exemplified in FIG. 1. The reinforcing mesh tape layer 26 is preferably manufactured from 150 denier polyester although any other type of synthetic or non-synthetic fiber can be employed. In the preferred embodiment of the invention, the mesh tape can be woven or knitted, although any other suitable construction is contemplated. The mesh tape shown in FIG. 5 has an open knit construction with texterized form that defines an X-Y matrix having more than about 15 picks per inch or preferably about 22 picks per inch. The mesh tape 26 has a relatively narrow width W of approximately 0.75 inches and need only be wide enough to wrap once around the layer of primary insulation 24. The reinforcement layer is a critical component of a spark plug ignition cable as will be explained later in greater detail.

Applied directly over the mesh tape layer 26 is a layer of secondary insulation 28, which forms the outer jacket of the cable 20. Since the mesh tape layer 26 and the secondary insulation 28 are applied to the cable almost simultaneously, as will be described later on in detail, these layers become interwoven with each other, virtually forming a single layer.

In the preferred embodiment of the invention, the secondary insulation 28 comprises a high temperature and oil resistant elastomeric coating sold under the trademark of HYPALON and manufactured by the DuPont Corporation. Alternatively, any other suitable well known materials such as ethyl vinyl acetate or silicone rubber can be used in the invention. The preferred diameter of the secondary insulation layer 28 is approximately 7 to 9 millimeters.

The earlier described mesh tape layer 26 substantially limits the cable's ability to stretching under conditions of extreme heat when a tension force is applied to the cable. Limiting the cable's ability to stretch under high temperature prevents "thinning" of the cable, i.e., cable diameter reduction. This is important in preventing the metal terminals (not shown), applied to each end of a completed spark plug cable assembly by crimping, from slipping off the cable when the cable is subjected to tension forces. In addition to limiting high temperature cable stretching, the reinforcement layer must also be sufficiently pliable at low temperatures so that the reinforcement layer does not crack or break when the cable is bent.

Standards have been set by the automotive industry for high temperature stretching and low temperature bending of spark plug ignition cables. Spark plug ignition cables must be capable of passing both a "Hot Terminal Pull-Off" test and a "Cold Bend" test.

In the Hot Terminal Pull-Off test, the metal terminal of a completed cable assembly is attached to a spark plug terminal or like fixture. The temperature of the assembly is raised to approximately 250° F. and then a pulling force is applied to the end of the cable opposite the terminal end. The cable must be capable of receiving a 27–28 pound pulling force without the cable pulling out of the crimped on metal terminal.

In the Cold Bend test, the cable is cooled to –20° F. and then wrapped around a mandrel having a diameter that is approximately 3 times the diameter of the cable. The reinforcing tape layer along with the other components of the wire, must be pliable enough at this temperature not to crack or break.

Both of these tests ensure that the cable will not fail under extreme conditions experienced in service. As is well known, the underhood temperatures of modern day automobiles can attain several hundred degrees F. Moreover, internal combustion engines produce various vibrations, move about on elastically configured mounting blocks, and must be capable of operating in extremely cold and hot environments.

Cables manufactured according to the present invention have been extensively tested and easily meet and/or exceed the above described tests.

Moreover, the novel use of a mesh tape reinforcing layer in the present invention provides substantial reductions in the manufacturing cost of the cable when compared with cables employing braided reinforcing layers. This is because the secondary insulation 28 and the mesh tape layer 26 are both applied over the primary insulation 24 of the cable at approximately the same rate of speed and substantially as the same time. This eliminates the cost and inefficiency associated with the braiding process of the prior art method.

Figure 4A:
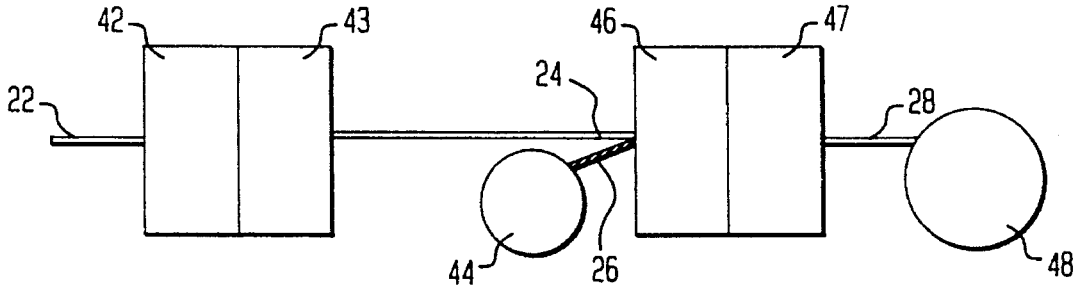
FIG. 4A is a schematic representation of the method used in making the cable shown in FIG. 2.

FIG. 4A depicts the method used in making the cable 20 shown in FIG. 2. The apparatus used in the method consists essentially of extrusion machines which extrude the primary and secondary insulation layers and vulcanizing chambers which cure the insulation layers of the cable 20. The extrusion machines most commonly used in the method of the present invention are manufactured by DAVIS STANDARD of Pawcatuck, Conn. The vulcanizing chambers used in the present method are of the type known in the industry as continuous vulcanization line. These extrusion machines and vulcanizing chambers are well known by persons in the electrical cable manufacturing art.

In the first step of the method, the conductor 22 of cable 20 is fed into a first extrusion machine 42 which extrudes the layer of primary insulation 24 over the conductor 22. The cable 20 then passes through a first vulcanization chamber 43 to vulcanize the layer of primary insulation 24.

Figure 4B:
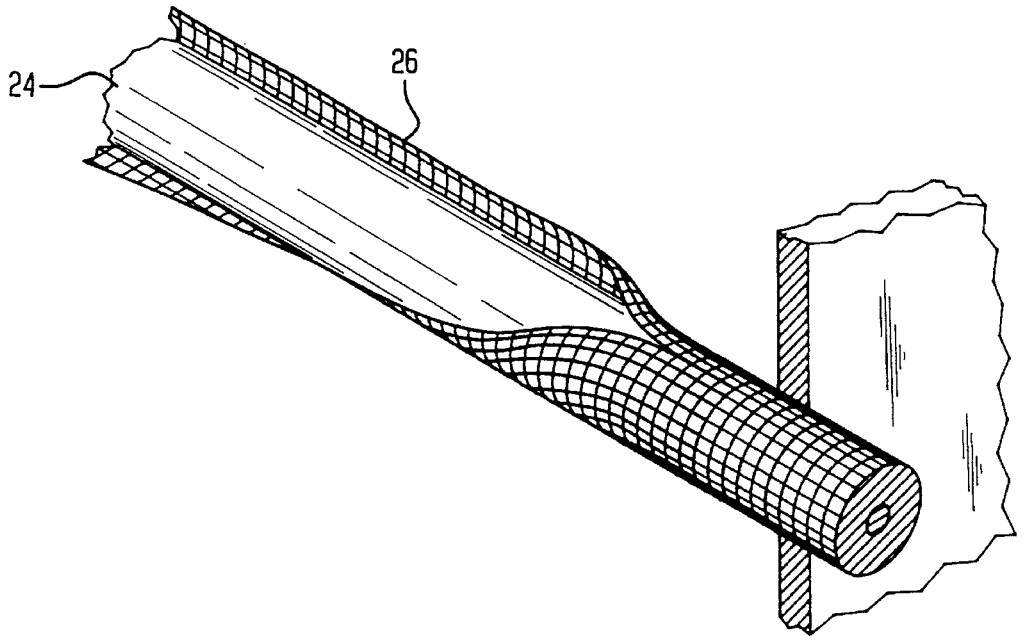
FIG. 4B is a close up view of the cable as it enters the entrance of the second extruding machine.

After the primary layer of insulation 24 has been vulcanized, the cable 20 is ready to receive the reinforcement and secondary insulation layers described above. The reinforcing mesh tape 26 is supplied on a spool 44. The cable 20 and the mesh tape 26 are both fed into a second extrusion machine 46. The mesh tape 26 is longitudinally wrapped "cigarette style" around the primary insulation layer 24 as shown in FIG. 4B as the cable enters the entrance of the second extruding machine 46. Any suitable guiding fixture (not shown) can be employed at the entrance of the extruding machine 46 to guide the tape longitudinally around the primary insulation layer 24. Such fixtures are well known, for instance, in the cigarette art for longitudinally wrapping paper.

Immediately after the tape is wrapped around the primary insulation layer 24, the secondary layer of insulation 28 is extruded over the mesh tape layer 26 of the cable 20, thus forming an interwoven layer of insulation and mesh tape.

The cable 20 then passes through a second vulcanization chamber 47 to vulcanize the secondary insulation layer 28. As the cable emerges from the second vulcanization chamber 47, the completed cable 20 is wrapped onto a spool 48.

In the above-described method, when silicone rubber is used for either the primary or secondary insulation layers, such layers are extruded at approximately 70° F. Insulation layers made from HYPALON, EPDM or ethyl vinyl acetate are extruded at approximately 200° F. All the insulating layers regardless of their composition, are vulcanized at approximately 400° F.

The employment of the mesh tape in the present invention, enables the cable reinforcing layer to be applied over the primary insulation of the cable at approximately the same rate of speed and virtually at the same time as the secondary insulation is extruded over the cable. This provides a substantial reduction in the cost of the cable as money needn't be expended on procuring the multiple braiding machines which are no longer necessary. Further cost reductions are realized from the elimination of the braiding machines in the form of lower energy costs and lower maintenance and set-up costs. Also savings in floor space, running one step operation instead of three, and the noise reduction because braiding machines must be enclosed.

It should be understood that the embodiment described herein is merely exemplary and that a person skilled in the art may make many variations and modifications to the embodiment utilizing functionally equivalent elements to those described herein. Any and all such variations or modifications as well as others which may become apparent to those skilled in the art, are intended to be included within the scope of the invention as defined by the appended claims.

We claim:

1. A method of manufacturing a cable, comprising the steps of:

providing conductive means for conducting electrical current;

applying a first layer of insulation over said conductive means;

wrapping a mesh tape longitudinally around said first layer of insulation at substantially same time as a second layer of insulation is applied over said mesh tape, wherein said mesh tape and said second layer of insulation are interwoven with each other.

2. The method according to claim 1, wherein said wrapping and said applying of said second layer both occur at substantially the same rate of speed.

3. The method according to claim 1, wherein said first and second layers of insulation are applied by extrusion.

4. The method according to claim 1, further comprising the steps of curing said first layer of insulation before said step of wrapping and curing said second layer of insulation after said second layer of insulation is applied.

5. The method according to claim 4, wherein said first and second layers of insulation are cured by vulcanizing.

6. A method of manufacturing a cable, comprising the steps of:

providing conductive means for conducting electrical current;

applying a first layer of insulation over said conductive means;

longitudinally wrapping a mesh tape around said first layer of insulation at a given rate of speed; and applying a second layer of insulation over said mesh tape at substantially said given rate of speed, wherein said mesh tape and said second layer of insulation are interwoven with each other.

7. The method according to claim 6, wherein said first and second layers of insulation are applied by extrusion.

8. The method according to claim 6, wherein said given rate of speed is approximately 300 feet per minute.

* * * * *